US006056788A

United States Patent [19]

Rössler et al.

[11] Patent Number: 6,056,788

[45] Date of Patent: May 2, 2000

[54] PROCESSES FOR CREASING MOIST WOOL FABRICS

[75] Inventors: Erich Rössler, Stadtbergen; Simpert Lüdemann, Bobingen; Jürgen Riedmann, Steppach; Hans-Peter Röhring, Lützelburg/Gablingen, all of Germany

[73] Assignee: Ciba Specialty Chemicals Corporation, Tarrytown, N.Y.

[21] Appl. No.: 09/034,505

[22] Filed: Mar. 4, 1998

[30] Foreign Application Priority Data

Mar. 4, 1997 [DE] Germany ..... 197 08 632
Oct. 2, 1997 [DE] Germany ..... 197 43 639

[51] Int. Cl.[7] ..... D06M 15/705

[52] U.S. Cl. ..... 8/115; 8/114; 8/127.6; 8/128.1; 8/128.3

[58] Field of Search ..... 8/127.6, 128.1, 8/128.3, 114, 115, 491, 493

[56] References Cited

U.S. PATENT DOCUMENTS

| | | | |
|---|---|---|---|
| 3,497,310 | 2/1970 | Farmer et al. | 8/127.6 |
| 3,542,505 | 11/1970 | Pittman et al. | 8/127.6 |
| 3,639,098 | 2/1972 | Delmenico et al. | 8/128.1 |
| 3,640,675 | 2/1972 | Thomas | 8/127.6 |
| 3,676,057 | 7/1972 | Brown | 8/127.6 |
| 3,684,430 | 8/1972 | Cook et al. | 8/128.1 |
| 3,687,605 | 8/1972 | Farmer | 8/127.6 |
| 3,797,997 | 3/1974 | Feldtman et al. | 8/127.6 |
| 3,822,995 | 7/1974 | Habib | 8/127.5 |
| 3,856,464 | 12/1974 | Dobinson et al. | 8/127.6 |
| 3,898,197 | 8/1975 | Guise et al. | 8/127.6 |
| 4,144,027 | 3/1979 | Habib | 8/127.6 |

FOREIGN PATENT DOCUMENTS 1435085 5/1976 United Kingdom .

OTHER PUBLICATIONS

Grant and Hackh's Chemical Dictionary, Fifth Edition, McGraw–Hill Book Company, p. 196, 1987 ( No Month Available).

*Primary Examiner*—Caroline D. Liott
*Attorney, Agent, or Firm*—Kevin T. Mansfield

[57] ABSTRACT

Creases with excellent resistance to washing processes can be produced in 30 to 100% by weight wool fabrics by means of a specific process. The fabrics are preferably in the form of garments; the process can be used to produce trouser creases, for example. The process consists in applying at least one compound having isocyanate groups to the fabric and pressing creases into the fabric under certain moisture and temperature conditions.

13 Claims, No Drawings

PROCESSES FOR CREASING MOIST WOOL FABRICS

The invention relates to a process for treating a fabric which is 30 to 100% by weight wool. This fabric is preferably in the form of a made-up garment such as a trouser or a skirt.

Garments, such as skirts or trousers, are frequently desired with creases, for example front and back edges in trouser legs, for reasons of fashion. Such creases can be produced by pressing. It is known, for example, to produce creases in made-up wool trousers by pressing the dry trouser at elevated temperature. The disadvantage of such hot-press creases is that they lose their initial sharpness after just a few washes, frequently after just one domestic wash. The durability of such creases to wool cycle washing in the washing machine (30° C.) thus leaves very much to be desired. These trousers therefore have to be hot-pressed again after every wash or after every few washes.

DE-A 20 54 159 and DE-A 19 06 514 describe processes for treating garments comprising wool. Creases produced in wool trousers by the processes specified in these two references are found not to possess optimal durability to wash processes (washing machine wash at 30° C.).

U.S. Pat. No. 3,687,605 describes a multistep process for treating wool fabrics for the purpose of producing creases. The process comprises treating the fabric with a polymer or prepolymer and then subjecting it for external stabilization to a curing process in which the fabric is dried. The fabric is then treated with a reductant and thereafter shaped, for example hot-pressed. For optimal results it is necessary to moisten the fabric with water prior to pressing. Pressing has to be finally followed by a further thermal curing treatment in order that the chemical bonds in the wool fiber which have been split by the reductant are re-formed. This multistep process is relatively complicated.

It is an object of the present invention to provide an improved process for producing, in the desired areas of fabrics which are 30 to 100% by weight wool, creases having improved durability to washing processes, especially in fabrics which are in the form of made-up garments.

This object is achieved by a process for treating a fabric which is 30 to 100% by weight wool by applying a component A to said fabric, adjusting said fabric to a moisture content of 10 to 80% by weight, preferably 30 to 60% by weight, and then pressing creases into said fabric at a temperature within the range from 80 to 200° C., preferably 130 to 170° C., said component A being a compound having at least two isocyanate groups in free or blocked form or being a mixture of such compounds.

It was found that, surprisingly, the durability of creases in fabrics to washing processes can be distinctly improved by this process. The process of the present invention makes it possible to produce creases, in made-up trousers comprising wool fabric, which substantially retain their shape even after 20 or more customary wool cycle washes in domestic washing machines.

If the process of the present invention is carried out at certain moisture-content values after pressing, it is possible, even in the case of fabric having a dark color or in the case of fabrics having high basis weights, to improve the durability of creases without undesirable visual effects appearing at the surface. This is more particularly described below.

The process of the present invention presses creases into wool-comorisina fabrics. The fabrics are preferably in the form of made-up garments in which creases are to be produced and/or stabilized. The garments can be, for example, skirts in which pleats are to be produced and/or stabilized. The process of the present invention is particularly useful for producing high-durability creases in trousers.

Fabrics useful for the process of the present invention are 30 to 100% by weight wool. 0 to 70% by weight can be other materials, for example polyester, polyamide, cotton. Lycra is a useful blending partner, too. The process of the present invention is preferably applied to fabrics which are 50 to 100% by weight wool. A wool content of 50 to 100% by weight in the fabrics or garments brings out the advantages of the process of the present invention over the prior art described at the beginning to a particularly marked extent. The wool component of the fabrics can be sheep's wool of any provenience. The quality of the wool is not critical with regard to the feasibility of the process of the present invention, but it does of course have an effect on the quality of the final article.

The articles which are obtained after the process of the present invention has been carried out have better properties when the process is carried out on fabrics whose aqueous extract has a pH of about 6 to 10. Advantageously, therefore, the pH of the fabric to be treated is tested before the process of the present invention is carried out by extracting a sample of the fabric with water. If the extract has a pH outside the abovementioned limits, as may be due to the pretreatment of the fabric, for example the dyeing process, it is advisable to treat the fabric or made-up garment in an aqueous bath and to dry the fabric or made-up garment before the process of the present invention is carried out. The bath used for this purpose is, for example, an aqueous solution of $NH_3$, $Na_2CO_3$ or $NaHCO_3$. The treatment of the fabric can be carried out by dipping into the room-temperature bath for a period of 10 to 30 minutes. The subsequent driving can take place in room-temperature air until the attainment of the equilibrium moisture level.

The thickness and construction of the fabrics on which the process of the present invention is carried out are not critical and can be varied within wide limits. To obtain optimal results in a particular case, the conditions of the process of the present invention, such as temperature, residence time and pressure during the pressing step, have to be adapted to the characteristics of the fabric used, which is possible by a few routine experiments. For instance, relatively thick fabrics normally require higher pressures and/or residence times for pressing the creases than relatively thin ones. When adapting the process parameters to the fabric properties it is of course necessary to comply with the conditions mentioned above.

The process of the present invention comprises a first step of applying a component A to the fabric or garment to be treated. Care must be taken in particular to ensure that component A is applied at least to those areas of the fabric where creases are to be pressed in during the later pressing step, but preferably component A is applied to the entire fabric surface. Component A is advantageously applied by impregnating the fabric or garment with a bath or liquor, for example by dipping. However, application by spraying component A onto the fabric is also possible. For this, component A must of course be in a sprayable form, for example in a mixture with a diluent.

It is frequently advantageous and hence constitutes a preferred embodiment of the process of the present invention to apply to the fabric or garment not just a component A, but additionally a component B. Everything said in relation to the application of component A also applies to the application of component B, if a component B is used. It is thus necessary to ensure that, after application of component B, the fabric has the requisite moisture content for the later pressing operation, before this pressing operation is carried out.

The additional use of a component B is advisable especially when component A is a low molecular weight compound, for example a monomeric diisocyanate or an oligomer having a molecular weight of less than about 1000. In these cases, the properties of the treated fabric can be improved by the inclusion of a component B, for example with regard to an antifelting finish. As a result of the process of the present invention, the fabric or garment acquires a good antifelting finish. However, even if component A is a polymer having a molecular weight of more than 1000, the inclusion of a component B can yield advantages; for example, if component B is a soft-hand agent, the fabric will acquire a pleasantly soft hand after the process of the present invention has been carried out. However, it is also possible to apply to the fabrics, in place of or in addition to component B, soft-hand agents which do not fall within the definition of component B mentioned below. The soft-hand agents known from textile finishing are useful here, for example fatty acid, fatty alcohol or fatty amine derivatives.

In most cases it is advantageous, for cost reasons among others, and hence preferable if the process of the present invention is carried out with a component B for said components A and B and optionally further components to be applied to the fabric or garment at one and the same time. In principle, component A can also be applied before or after component B. This is less preferable, but can turn out to be necessary or expedient in a particular case, for example if it is impossible to find a stable formulation of both components A and B. A preferred embodiment of the process of the present invention comprises preparing an aqueous composition comprising component A and component B and optionally further components and treatina the fabric or aarment with this composition. The aqueous composition is preferably a stable solution or dispersion, for example an emulsion comprising dispersants such as emulsifiers as well as components A and B. This aqueous dispersion may additionally include further products to impart desirable properties to the fabrics, for example soft-hand agents and fluorine-containing polymers for water-repellent and/or oil-repellent properties. Useful products of this type are well known in textile finishing. Examples of fluoropolymer products which can be applied to the fabrics in combination with component A are the products OLEOPHOBOL® S, OLEOPHOBOL® SL and OLEOPHOBOL® 7596 from Ciba Spezialitatenchemie Pfersee GmbH, Germany. These products can be combined with component A and optionally a component B in one and the same liquor, so that this is an effective way of providing permanent (trouser) creases, antifelting finish and water/oil repellency. The quantities of fluoropolymers advantageously applied to the fabrics are within the range which is customary in textile finishing for achieving oil/water repellency with these products.

Component A, applied to the fabric or garment by the process of the present invention, is a compound which has at least two isocyanate groups. Some or all of the isocyanate groups present can be in blocked form. As well as these isocyanate groupings, further functional groups may be present in component A.

Component A can be a monomeric compound having two or more free or blocked isocyanate groups, but the molecular weight of A should not be below 160. Preferably, however, component A is a higher molecular weight compound, for example an oligomer or polymer, obtainable by addition homopolymerization, addition copolymerization, polyaddition or polycondensation. Component A preferably has a molecular weight of more than 500. Component A must contain at least two isocyanate groups, which need not be in free form, but can be blocked. Component A preferably has one to twenty isocvanate groups per 100 carbon atoms. Instead of a defined compound, component A can also be a mixture of compounds which each contain two or more isocyanate groups. The molecular weight of component A is advantageously between 160 and 100,000, preferably between 500 and 25,000.

Component A contains isocyanate groups in free and/or blocked form. Isocyanate groups in blocked form are herein to be understood as meaning functional groups which are formed by reaction of free —NCO groups with blocking agents and which are converted back into isocyanate groups in a reversible reaction at elevated temperature. Suitable blocking agents, i.e., compounds which react with —NCO groups in a thermally reversible reaction, are known from the literature and include, for example, ketone oximes. The blocked isocyanate groups preferred for the process of the present invention are preferably obtained by reaction of free isocyanate groups with bisulfite. The blocking reaction is advantageously carried out by reacting the isocyanate groups with sodium bisulfite or potassium bisulfite in a conventional manner.

The process of the present invention is preferably carried out by applying component A and, if used, component B to the fabric in the form of an aqueous composition. This composition will normally be an aqueous dispersion or emulsion or else solution. It is preferable in this case for stability reasons for all, or almost all, isocyanate groups of component A to be in blocked form, preferably in the form of a blocking with bisulfite. Polyurethanes having isocyanate groups blocked by reaction with bisulfite are particularly useful as component A.

The isocyanate groups are preferably in blocked form if component A is used in the form of an aqueous composition.

U.S. Pat. No. 3,687,605 describes a number of polyurethanes which are useful as component A for the process of the present invention and also other isocyanato-containing startina compounds useful as conmonent A. from which such polyurethanes are obtainable. This U.S. reference further discloses other polymers, and polymer precursors, which are likewise useful as component A, although, in certain circumstances, the use of a component B may be necessary. However, when preparing polymers according to this U.S. reference, care must be taken to ensure that the resulting polymers have to contain free and/or blocked isocyanate groups to be useful as component A. It is assumed that component A is capable of reacting chemically with the wool of the fabric and/or with component B via the isocyanate groups, if necessary after removal of the isocyanate-block.

Products useful as component A are obtainable, inter alia, by reacting aliphatic, alicyclic or aromatic diisocyanates with polyhydric alcohols to form oligo- or polyurethanes. Chain extenders known from polyurethane chemistry may be used here in addition. The reaction to form the oligo- or polyurethane is carried out with an excess of isocyanate equivalents, so that the reaction product still has free NCO groups. If desired, these can then be partly or wholly blocked by reaction with an alkali metal bisulfite. Products useful as component A are commercially available.

Component B, which, in a preferred embodiment of the process of the present invention, is likewise applied to the fabric or garment, is an organic compound which has at least two hydroxyl groups in the molecule. These hydroxyl groups are capable of reacting with the isocyanate groups of component A, if necessary after thermal unblocking of the isocyanate groups. Component B is suitably a dihydric or more highly hydric alcohol, especially a comparatively long-chain alcohol whose chain may be interrupted by ether groupings. Component B is particularly preferably a polymer, especially a polyester, polyamide or polyalkylene glycol containing free hydroxyl groups. The polyalkylene glycol can be a polyethylene glycol or a polvorouvlene glycol or a corolvmer of ethvlene glycol and propylene glycol. Instead of a single compound with two or more hydroxyl groups, component B can also consist of a mixture of such compounds.

The process of the present invention provides particularly good results when component B comprises a polydiorganosiloxane having at least two free hydroxyl groups per molecule. Especially linear polydimethylsiloxanes having a hydroxyl group attached to each of the two terminal silicon atoms are very useful as component B. When these silicones are used as component B, the process of the present invention makes it possible to obtain trousers having not only excellent crease durability, but also a pleasantly soft hand. This applies even more when a polyurethane having bisulfite-blocked isocyanate groups is used as component A in combination with this component B. In this case, crease durability can be further enhanced by a setting treatment carried out after pressing. This preferred embodiment is more particularly described below.

A suitable component B is the product DICRYLAN® WK neu from Ciba Spezialitatenchemie Pfersee GmbH, Germany.

An aqueous composition which includes both component A and component B and is very useful for the process of the present invention is the product DICRYLAN® WSR from Ciba Spezialitatenchemie Pfersee GmbH.

The amounts of component A and component B which should be applied to the fabric or garment in the process of the present invention can be varied within wide limits. The preferred procedure is to treat the fabric with an aqueous liquor comprising A and B. This impregnation, which can be effected, for example, by dipping the fabric into the liquor, is then followed by a step in which the fabric or garment is pinched off or whizzed to remove excess moisture. Pinching and whizzing are preferably carried out in such a way as to leave the fabric with a liquor pick-up of 10 to 80% by weight, preferably 30 to 60% by weight, based on the dry fabric prior to impregnation with liquor. After pinching or whizzing, the fabric should thus exhibit a weight increase within the stated range, based on dried fabric prior to impregnation. The concentrations in the treatment liquor are preferably selected so that, after pinching or whizzing, the fabric has an add-on of 0.25% by weight to 2.5% by weight of component A and 0.05% by weight to 0.5% by weight of component B, preferably 0.5 to 1.8% by weight of A and 0.1 to 0.3% by weight of B. These percentages are each based on dry fabric prior to the impregnating step.

If the process of the present invention is to be carried out without use of a component B, the above directions as to the liquor pick-up of the fabric and as to the amount of component A on the fabric continue to apply.

It is further preferable for a numerical excess of isocyanate units of component A compared with the nnumber of hydroxyl groups of component B to be present on the pinched-off or whizzed fabric following application of components A and B, so that excess isocyanate groups will still be present even if all the hydroxyl groups of B were to react with isocyanate groups of A. If, as well as component B, further hydroxyl-containing products have been used, an excess of isocyanate groups should likewise be present after pinching.

When a component B is used, the preferred procedure is to leave a weight ratio of component A to component B within the range from 10:1 to 3:1 on the fabric following whizzing and pinching.

As well as components A and B, the process of the present invention may be used, if desired, to apply additionally to the fabric a catalyst to promote the reaction of isocyanate groups with hydroxyl groups. Suitable catalysts are known from the literature.

After application of components A and optionally B to the fabric and, as the case may be, whizzing or pinching off to the desired liquor pick-up, it is necessary to adjust the moisture content of the fabric or garment to 10 to 80%, preferably 30 to 60% by weight, before the desired creases are pressed in. A moisture content within the stated range at the start of the pressing operation is a crucial requirement of the process of the present invention. Especially the areas in which the creases are subsequently to be pressed in must have a moisture content within the stated range. If, as described below, the whizzing or pinching is followed by further operations such as, for example, treatment on a garment-blower before the creases are pressed in, the moisture content is set after these operations.

The values mentioned above for the moisture content define the amount of water present on the fabric, based on the weight of this fabric after drying at 110° C. for 30 minutes. The reference fabric weight is thus the fabric dried under these conditions when component A and optionally component B are already present on it (minus the constituents which volatilize under the drying conditions). The range mentioned above for the moisture content thus has to be established before pressing is commenced. Prior to pressing being carried out, it is thus necessary to determine the moisture content, unless it is already known from experience and on the basis of process parameters. Depending on the conditions of the preceding treatment, the moisture content may already be within the requisite range.

It is advantageous for the preceding treatment to be carried out under such conditions that the post-treatment moisture content of the fabric or garment is already within the requisite range. Given knowledge of the requisite parameters within a standard production set-up, the moisture content of the fabric prior to pressing will already be known from experience or can be calculated, so that a determination of the moisture content may be dispensed with. If the moisture content is already within the requisite range, no corrective measures are necessary. If not, the requisite moisture content has to be set by addina moisture or drying. Any drying has to be carried out under benign conditions in order that chemical reaction of the isocyanate groups may be avoided.

In many cases it is advantageous to subject the fabric or garment to treatment on a garment-blower prior to the establishing of the moisture content prior to the pressing operation. Treatment on a garment-blower involves clamping the fabric at two ends, for example a trouser at its upper and lower ends. The fabric is then briefly treated with a stream of hot air or with a mixture of steam and air. In the case of trousers, it is advantageous to clamp the trousers at their upper and lower ends, to seal the lower end and to blow air down the inside of the trouser legs. The air, which normally has a temperature of about 40 to 120° C. and is dry, passes through the fabric. The purpose of this treatment is to smooth the surface of the fabric and thus facilitate the subsequent pressing operation to press in creases. This treatment on a garment-blower can also take place after the application of components A and optionally B and subsequent pinching and whizzing of the fabric. It is advantageous to carry out the treatment on a garment-blower in such a way that the fabric or garment does not become dry, but still has a moisture content of 10 to 80% by weight, preferably of 30 to 60% by weight. This is the moisture content range which the fabric must have after the subsequent pressing operation at least in those areas where creases are to be pressed in. The moisture content of the fabric after treatment on a garment-blower can be controlled via the temperature of the hot air or via the duration of the supply of this air. Instead of blowing in hot air alone, it is also possible to use a mixture of super-heated steam (120° C.) and air at the beginning and subsequently just air.

After treatment on a garment-blower, trousers can be subjected to an ironing operation in the regions where no creases are to be pressed in later. for example to iron seams on the inner surface of the trouser legs by hand. However, this should take place under benign conditions.

The subsequent pressing operation of pressing creases into the fabric or garment requires that the fabric have a moisture content of 10 to 80% by weight, preferably 30 to 60% by weight. These percentages define the water content of the fabric, based on dried fabric, as described above. The fabric has to have a moisture content within this range at least in the areas where creases are to be pressed in. Normally, the fabric has a moisture content within this range everywhere.

It is advantageous for the process steps preceding the pressing operation, namely application of components A and optionally B, whizzing or pinching, optional treatment on a garment-blower and optional manual ironing, to be carried out in such a way that the fabric already has the requisite moisture content for the pressing operation after the last of these steps. In this case, the pressing operation can be carried out without prior additional measures to increase or reduce the moisture content. What should be avoided, at any rate, is that the fabric is completely dry at any time between the application of component A and the pressing operation.

The next step involves pressing creases into the fabric or garment, for example front and back edges in the case of trousers or pleats in the case of skirts. The creases may have already been preformed in an earlier operation by application of a slight pressure. However, it is also possible to create creases in a previously crease-free fabric. For the pressing operation, the fabric is laid out in such a way that a crease is preformed in the desired area. This crease is then pressed in at a temperature within the range from 80 to 200° C., preferably 130 to 170° C., under application of a pressure. It is to be noted that the range specified for the temperature does not apply to the temperature of the press (which can be higher), but to the temperature which the fabric has in the areas where the creases are pressed, on the surface remote from the press. In the case of trousers, this is the inner surface of the creases. The temperature of the fabric on the surface remote from the press can be measured by means of a temperature sensor and controlled via the process parameters. The statement that the pressing operation has to be carried out at a temperature within the range from 80 to 200° C., preferably 130 to 170° C., does not mean that the press-remote surface of the fabric in the area of the crease has to have a temperature within the stated range during the entire pressing operation. On the contrary, this surface needs to have a temperature within this range only at some point during the pressing operation. A residence time of 10 to 60 seconds at this temperature is then frequently sufficient for the fabric in the region of the creases either to be completely dry or to have a moisture content within the desired range, a necessary prerequisite for the creation of durable creases. The temperature need not be measured in the relevant areas of the fabric if it is known from experience with the process parameters that the temperature is already within the requisite range.

After pressing, as mentioned, the fabric has to have a certain moisture content in the areas where creases were pressed in. In the case of light-colored fabric, in the case of undyed fabric or in the case of fabrics having a low basis weight, it is frequently advantageous for the fabric in the areas of the creases to be virtually completely dry.

The pressing operation in these cases is preferably carried out in such a way that, after pressing, the fabric or garment is virtually completely dry in the areas where creases were pressed in. Otherwise, the durability of the crease to washing processes may be impaired. Complete drying of the fabric is simple to achieve via the duration of the pressing operation.

In the case of dark-colored fabric or in the case of fabrics having a high basis weight, by contrast, it is frequently advantageous for the fabric in the areas where creases were pressed in not to be completely dry after pressing, but for the fabric where creases were pressed in to have a moisture content which is 10 to 70% of the moisture content (in % by weight) in said areas prior to said pressing, but at least a moisture content of 5% (based on fabric weight in these areas). This frequently prevents or at least diminishes undesirable visual effects at the surface. The fabric can be dried down to the desired moisture content simply in the course of the duration of the pressing operation.

The pressure to be applied to press the creases can be varied within wide limits. It is advantageously adapted to the fabric properties and is preferably within the range from 1 to 10 bar. The pressing operation is suitably carried out with commercially available apparatus to obtain the requisite pressures and temperatures.

The duration of the pressing operation has to be sufficient for the fabric or garment in the areas where creases are pressed in to have the desired moisture content after pressing. This moisture content can vary according to fabric type. A prolonged residence of the fabric in the press is not necessary in most cases, but may be advantageous in a particular case. Normally, the duration of the pressing operation is within the range from about 5 seconds to several minutes, which depends, inter alia, on the press.

After pressing, the fabrics can be air dried at room temperature or elevated temperature (e.g., in a drying cabinet) until they have attained the equilibrium moisture content.

Thereafter further process steps customary in the making-up of ready-to-wear clothing can be carried out, including manual ironing in the areas where no creases were dressed in.

The process of the present invention makes it possible to provide wool-comprising fabrics with durable creases and an antifelting finish at one and the same time. More particularly, provided suitable components A and B are used, the fabrics treated according to the present invention have excellent antifelting properties. The textile finishing literature reveals which products among those which are useful as component A and component B can also be used to obtain an antifelting finish. A good combination of suitable components for obtaining durable creases in trousers coupled with an antifelting finish is the product DICRYLAN® WSR from Ciba Spezialitatenchemie Pfersee GmbH, Germany.

It is frequently advantageous—and often in fact indispensable—for optimal properties on the part of the fabric or garment for the pressing operation and optional drying to be followed by a setting treatment. To this end, the fabric is treated at 130 to 200° C., preferably at 140 to 180° C., for 5 to 30 minutes without application of any mechanical tension and without application of pressure.

This will normally reduce the felting shrinkage of the wool. This setting or curing can be carried out in a commercially available drying oven.

Embodiments of the present invention will now be more particularly described by way of example.

EXAMPLE 1

An aqueous liquor was prepared from the following ingredients as well as dispersants and auxiliaries:

a) 20 g/l of a polyurethane having isocyanate groups blocked by reaction with inorganic sulfite (component A).

b) 2.2 g/l of a linear polydimethylsiloxane (component B) having a hydroxyl group attached to the terminal silicon atom at each chain end. (In place of the separate components A) and B) it is also possible to use a product which is obtained by precedina chemical reaction of A) with B).)

c) 2 g/l of a linear polydimethylsiloxane having side chains with amino groups.

d) 5 g/l of $NaHCO_3$.

A wool trouser whose fabric content was 100% wool was dipped into this liquor at room temperature. After a dip time of 10 minutes, the trouser was completely wet. It was removed from the bath and whizzed to a liquor pick-up (=weight increase, based on dry trouser) of 50%. The whizzing was carried out by spinning in a washing machine for 70 seconds.

The trouser was then treated on a garment-blower for 20 seconds by clamping it at its upper and lower ends, sealing the lower openings of the trouser legs and blowing first a mixture of saturated steam (120° C.) and hot air for 10 seconds and then only hot air for 10 seconds down into the interior of the trouser. The trouser was turned inside out following the garment-blower treatment and the side-seams were ironed flat on the inside surface. After again being turned inside out, the trouser was introduced into a press. The heated platens of this press had a temperature of 220° C. After being placed into the press, the trouser was laid flat by hand and aspirated against the surface of the press platen by means of a vacuum. The press was closed, a crease was pressed into each leg of the trouser by application of 4 bar pressure for 2 minutes. The temperature was measured in the area of the crease on the inside of the trouser, i.e., on the press-remote surface. It was found to rise to 130° C. during the pressing operation. After pressing, the trouser was dry along the creases. It was air dried overnight to get the other areas to dry as well. The trouser was then set for 5 minutes at 150° C. in a thermal cabinet without application of tension. It was found that the best effects were achieved following a subsequent aging at room temperature for 1 week.

The trouser thus treated had sharply pressed creases, the appearance of which did not deteriorate to any Practical extent after 15 washes in a domestic washing machine (30° C., with circulation and addition of a surfactant to the wash liquor).

EXAMPLE 2

An aqueous liquor was prepared from the following ingredients as well as dispersants and auxiliaries:

a) 20 g/l of a polyurethane having isocyanate groups blocked by reaction with inorganic sulfite (component A).

b) 2.2 g/l of a linear polydimethylsiloxane (component B) having a hydroxyl group attached to the terminal silicon atom at each chain end. (In place of the separate components A) and B) it is also possible to use a product which is obtained by preceding chemical reaction of A) with B).)

c) 2 g/l of a linear polydimethylsiloxane having side chains with amino groups.

d) 5 g/l of $NaHCO_3$.

A wool trouser whose fabric content was 100% wool was dipped into this liquor at room temperature. After a dip time of 5 minutes, the trouser was completely wet. It was removed from the bath and whizzed to a liquor pick-up (=weight increase, based on dry trouser) of 50%. The whizzing was carried out by spinning in a washing machine for 70 seconds.

The trouser was then treated on a garment-blower for 20 seconds by clamping it at its upper and lower ends, sealing the lower openings of the trouser legs and blowing first a mixture of saturated steam (120° C.) and hot air for 10 seconds and then only hot air for 10 seconds down into the interior of the trouser. The trouser was turned inside out following the garment-blower treatment and the side-seams were ironed flat on the inside surface. After again being turned inside out, the trouser was introduced into a press. The heated platens of this press had a temperature of 150° C. After being placed into the press, the trouser was laid flat by hand and aspirated against the surface of the press platen by means of a vacuum. The press was closed, a crease was Dressed into each leg of the trouser by application of 6 bar pressure for 30 seconds. The temperature was measured in the area of the crease on the inside of the trouser, i.e., on the press-remote surface. It was found to rise to 100° C. during the pressing operation. After pressing, the trouser had a moisture content of about 15% by weight along the creases. The trouser was dried in a drying cabinet (150° C./10 min). The trouser was then set for minutes at 160° C. in a thermal cabinet without application of tension. It was found that the best effects were achieved following a subsequent aging at room temperature for 1 week.

The trouser thus treated had sharply pressed creases, the appearance of which did not deteriorate to any practical extent after 15 washes in a domestic washing machine (30° C., with circulation and addition of a surfactant to the wash liquor).

What is claimed is:

1. A process for treating a fabric which is 30 to 100% by weight wool, which comprises applying a component A to said fabric, adjusting said fabric to a moisture content of 10 to 80% by weight, and then pressing creases into areas of said fabric at a temperature within the range from 80 to 200° C., wherein said fabric is not dried completely between said application of said component A and said pressing, said component A being a compound having at least two isocyanate groups or being a mixture of such compounds, said isocyanate groups being present in free form or blocked with a ketone oxime or a bisulfite.

2. A process according to claim 1, wherein said pressing is effected in such a way that, after said pressing, those areas of said fabric where creases were pressed in have a moisture content which is 10 to 70% of the moisture content in % by weight in said areas prior to said pressing, but at least a moisture content of 5% based on fabric weight in those areas.

3. A process according to claim 1, further comprising applying to said fabric, in addition to said component A, a component B, said component B being an organic compound which has at least two hydroxyl groups or being a mixture of such compounds.

4. A process according to claim 1, wherein said component A is a polymeric compound.

5. A process according to claim 1, wherein said component A contains isocyanate groups blocked by reaction with bisulfite.

6. A process according to claim 3, wherein said component B is a polymeric compound having at least two hydroxyl groups and selected from the group of polyesters, polyamides, polyalkylene glycols and polydiorganosiloxanes.

7. A process according to claim 6, wherein said component B is a polydimethylsiloxane having an Si-attached hydroxyl group at each chain end.

8. A process according to claim 3, wherein said component A and said component B are applied to said fabric at one and the same time.

9. A process according to claim 8, wherein an aqueous composition comprising said component A and said component B is applied to said fabric.

10. A process according to claim 1, wherein said fabric is present in the form of a made-up garment.

11. A process according to claim 10, wherein said garment is a trouser and said creases are the front and back edges of the legs of said trouser.

12. A process according to claim 1, further comprising subjecting said fabric to a setting treatment at a temperature within the range from 130 to 200° C., after said pressing of said creases.

13. A process according to claim 4 wherein said polymeric compound is a polyurethane.

* * * * *